United States Patent [19]

Minter

[11] 4,341,048

[45] Jul. 27, 1982

[54] METHOD AND ASSEMBLY FOR CLADDING A WINDOW FRAME

[75] Inventor: Mearl J. Minter, Oskaloosa, Iowa

[73] Assignee: Rolscreen Company, Pella, Iowa

[21] Appl. No.: 153,448

[22] Filed: May 27, 1980

[51] Int. Cl.[3] ..... E06B 1/04; E06B 3/00

[52] U.S. Cl. ..... 52/211; 52/716; 49/504

[58] Field of Search ..... 52/211, 716; 49/504, 49/501

[56] References Cited

U.S. PATENT DOCUMENTS

| | | | |
|---|---|---|---|
| 2,779,983 | 2/1957 | Sundelin | 52/716 |
| 2,851,742 | 9/1958 | Johnston | 52/211 |
| 3,103,710 | 9/1963 | Fredricksen | 52/211 |
| 3,393,484 | 7/1968 | Dunnington | 52/716 |
| 3,478,478 | 11/1969 | Luebs | 52/211 |
| 3,662,494 | 5/1972 | Sitterly | 49/504 |
| 3,815,285 | 6/1974 | Kuyper | 49/501 |
| 4,193,238 | 3/1980 | Chalmer | 52/211 |
| 4,228,630 | 10/1980 | Englert | 52/211 |

FOREIGN PATENT DOCUMENTS

| | | | |
|---|---|---|---|
| 180024 | 7/1962 | Sweden | 52/211 |

*Primary Examiner*—Reinaldo P. Machado

*Attorney, Agent, or Firm*—Allegretti, Newitt, Witcoff & McAndrews

[57] ABSTRACT

An improved method and assembly for cladding an existing, exterior window frame. Frame expander receptors are fastened to the window frame head and jamb members. Frame expanders are retained in receiving recesses of the receptors. Cladding portions of the expanders clad the frame members and cover the fasteners for pleasing appearance. Moisture barriers separate the fasteners and the frame from the environment. A sill nose cover clads the sill.

7 Claims, 11 Drawing Figures

FIG. 2
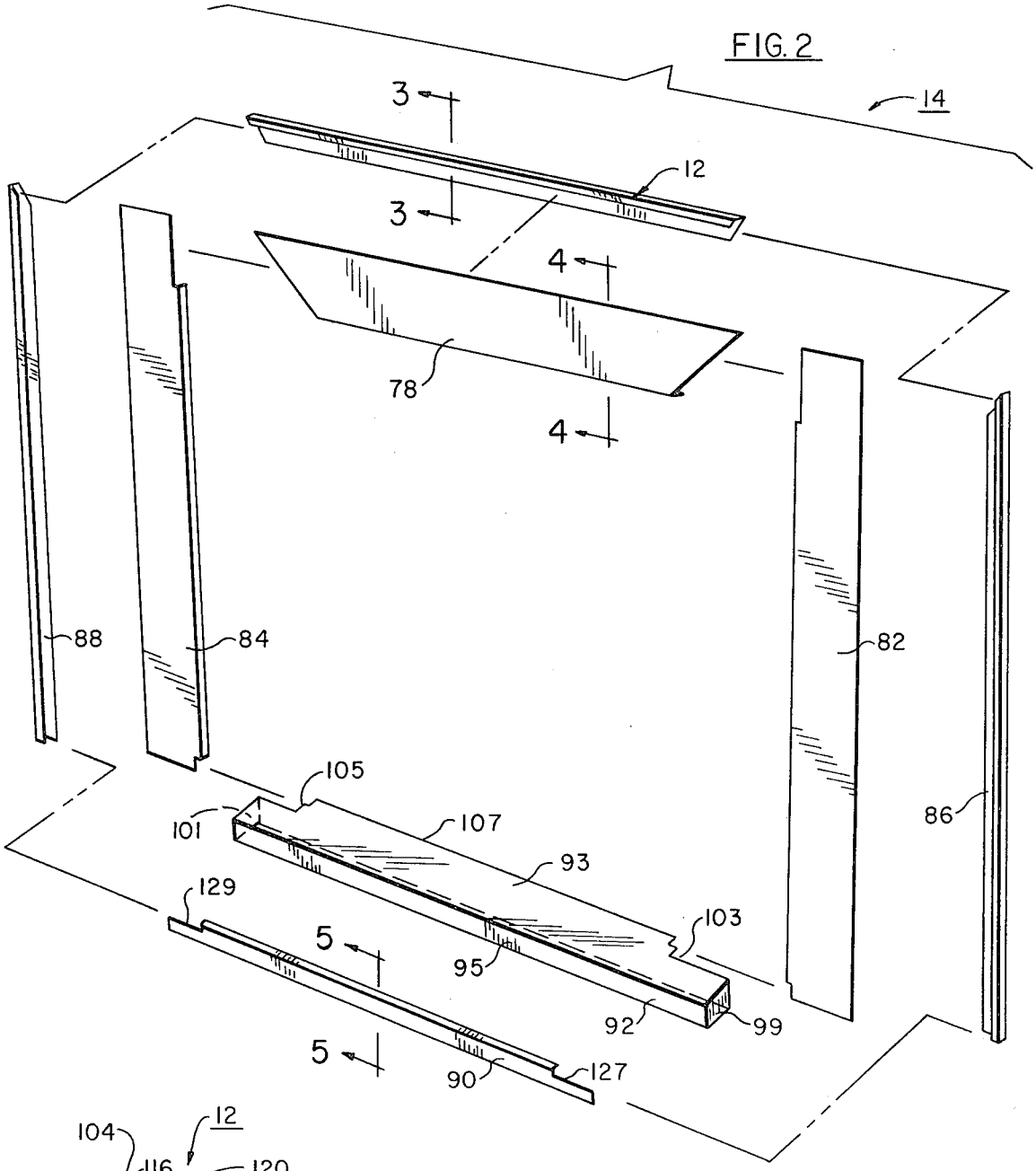
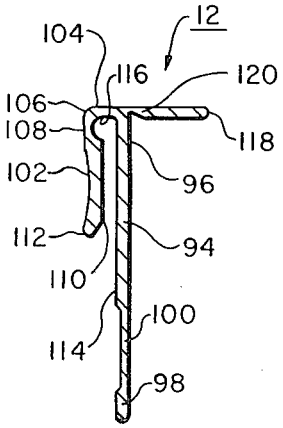
FIG. 3
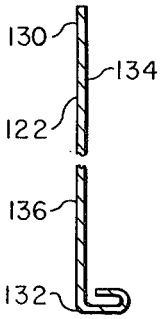
FIG. 4
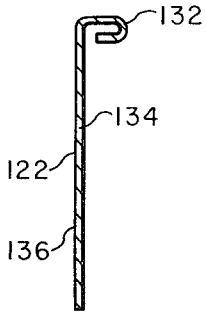
FIG. 5

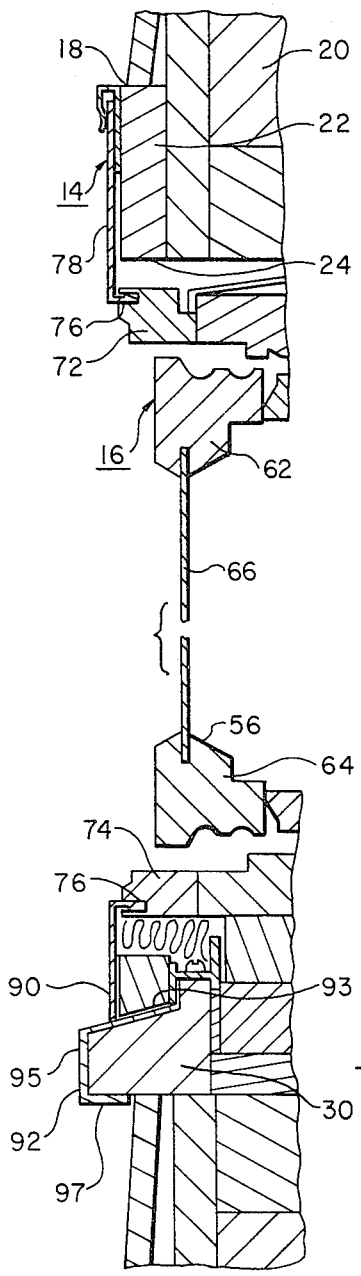
FIG. 6
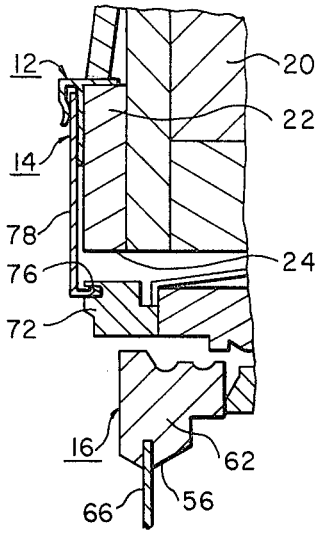
FIG. 8
FIG. 7
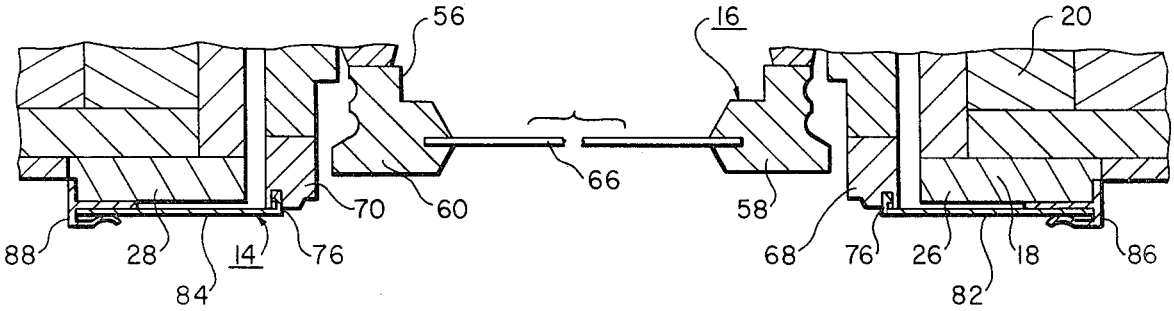

METHOD AND ASSEMBLY FOR CLADDING A WINDOW FRAME

BACKGROUND OF THE INVENTION

This invention relates to an improved window construction, and more particularly, to an improved method and assembly, including a frame expander receptor, for the cladding of the existing, exterior frame of a window.

With the increasing consciousness of the desirability of older buildings and the heat loss caused by poorly insulated windows, a need has arisen for insulated replacement window components. As disclosed in U.S. Pat. No. 3,815,285, metal clad, wooden windows have long been considered highly desirable for their ease of maintenance, superior insulation, pleasing appearance and long life. Exterior cladding of all window components, including both the sash and trim, has been most preferred. To date, however, the cladding of the exterior trim or frame has not been satisfactorily accomplished, where the original exterior trim of a window is retained after replacement of the sash. Previous attempts at cladding the exterior trim have all involved the fastening of cladding to the trim with fasteners such as nails or screws, the heads of which are left exposed. The exposed heads have caused an unsightly appearance, marring the visual integrity of many buildings. The entry points for the fasteners have also acted as entry points for moisture, which moisture, after entry, has been retained against evaporation along the fasteners and behind the cladding. This water retention has speeded deterioration of the wooden trim, damaging the soundness of the trim and weakening the hold of the fasteners. Since repair of a window by replacement of only the sash is widely preferred, the satisfactory cladding of the existing exterior frame of a window has become widely desired.

SUMMARY OF THE INVENTION

It is thus an object of the present invention to provide an improved method and assembly for the cladding of the existing, exterior trim or frame of a window.

Another object of the present invention is to provide an improved method and assembly for cladding an exterior window frame which provide for metal or plastic cladding over wooden exterior trim.

Another object of the present invention is to provide an improved method and assembly for cladding an exterior window frame which complement the architectural beauty of existing buildings while providing ease of maintenance and long life.

Another object of the present invention is to provide an improved method and assembly for cladding exterior window trim which substantially eliminate moisture entry into the trim.

Another object of the present invention is to provide an improved assembly for cladding exterior window trim which is economically manufactured and utilized.

Thus, in a principal aspect, the present invention is a window frame expander receptor for cladding a window frame. The receptor includes fastener flange means and flexible receptor flange means. The fastener flange means is for receiving fasteners therein. The flexible receptor flange means is for (a) defining a frame expander receiving zone, and (b) retaining a frame expander received in the frame expander receiving zone. With such a receptor, the window frame may be clad, the fasteners covered by the frame expander, and a moisture barrier created between the environment and the fasteners.

In a second principal aspect, the present invention is an assembly for cladding a window frame, where the frame has a head frame member and two jamb frame members. The assembly comprises a head frame expander, a head frame expander receptor, two jamb frame expanders and two jamb frame expander receptors. The receptors are formed in accordance with the first aspect of the present invention. The head frame expander and the jamb frame expanders each include a generally planar cladding portion for overlying the fastener flange means of the head frame expander receptor and the two jamb frame expander receptors, respectively, and for substantially cladding the head frame member and the two jamb frame members. Each expander has a back surface for disposition adjacent a frame member and a front surface for display to the environment. Together, the expanders and receptors define means for creating a moisture barrier between the fasteners and frame. With such an assembly, the window frame may be clad, the fasteners may be covered by the expanders and a moisture barrier created between the environment and the fasteners and frame.

In a third principal aspect, the present invention is a method of cladding a window frame by utilization of the assembly of the second principal aspect of the invention. The receptors are fastened to the frame members with the head frame expander receptor fastened to the head frame member and the jamb frame expander receptors fastened to the jamb frame members. The jamb frame expanders are then mounted on the jamb frame expander receptors, and the head frame expander mounted on the head frame expander receptor.

These and other objects, advantages and aspects of the present invention will become apparent from the Detailed Description of the Preferred Embodiments, which follows.

BRIEF DESCRIPTION OF THE DRAWING

The preferred embodiments of the present invention are described in the Detailed Description of The Preferred Embodiments with reference to the accompanying drawing. The eleven figures of the accompanying drawing are briefly described as follows:

FIG. 2 is an exploded view of the preferred apparatus of the present invention, as adapted to the window of FIG. 1 according to the preferred method of the present invention;

FIG. 3 is a cross-section view of a head frame receptor expander taken along line 3—3 of FIG. 2;

FIG. 4 is a cross-section view of a head frame expander taken along line 4—4 of FIG. 2;

FIG. 5 is a cross-section view of a sill frame expander taken along line 5—5 of FIG. 2;

FIG. 6 is a broken cross-section view of the rehabilitated window of FIG. 1, taken along line 6—6 of FIG. 1;

FIG. 7 is a broken cross-section view of the rehabilitated window of FIG. 1, taken along line 7—7 of FIG. 1;

FIG. 8 is a view similar to the upper half of FIG. 6, showing an alternative use of the head frame expander receptor of the present invention;

DETAILED DESCRIPTION OF THE PREFERRED EMBODIMENTS

Figure 1:
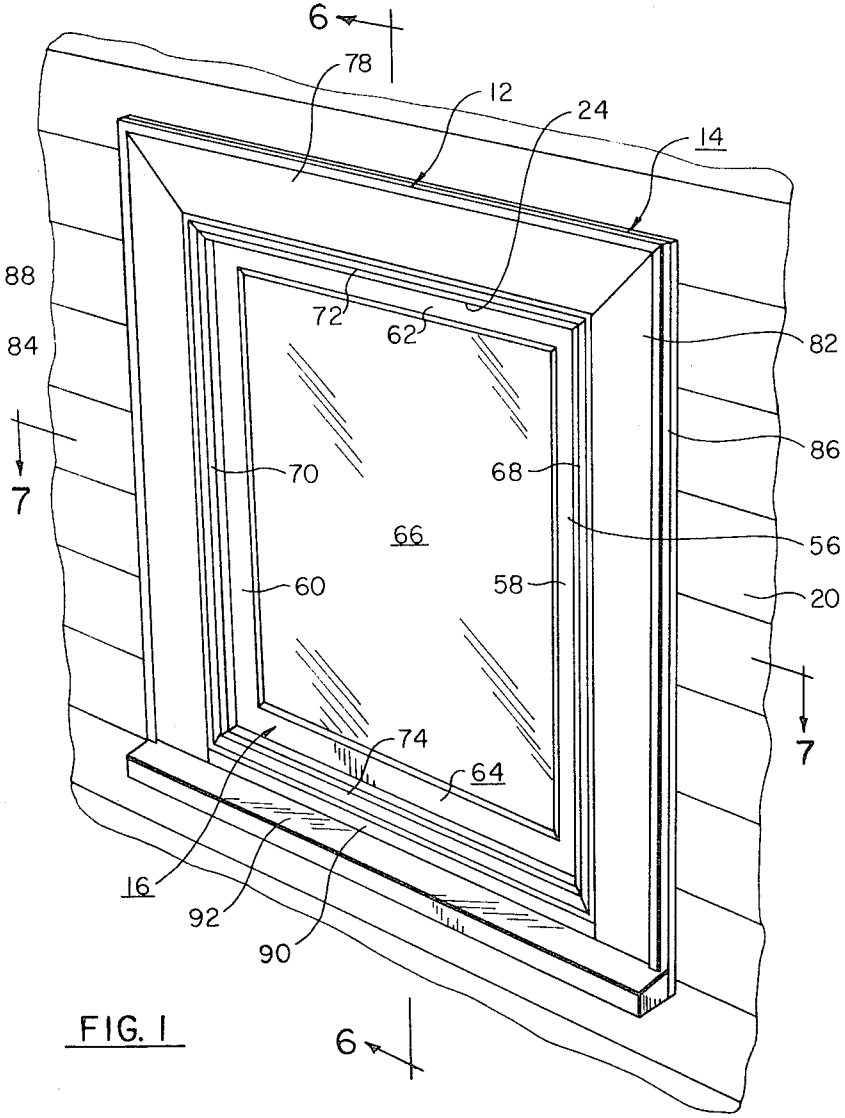
FIG. 1 is a pictorial view of a window as clad and rehabilitated utilizing the preferred embodiments of the present invention.

Referring to FIGS. 1-11 of the accompanying drawing, the preferred embodiments of the present invention are an exemplary frame expander receptor 12, shown in cross-section in FIG. 3; an assembly 14, shown exploded in FIG. 2; and a method of cladding a window by utilization of the assembly 14, as hereinafter described. As shown in FIG. 1, the utilization of the assembly 14 in the preferred method results in a rehabilitated window 16 having, among other advantages, a most pleasing appearance. Contrasting FIG. 9 with FIG. 1, the window 16 prior to application of the assembly 14 may have had a most displeasing appearance, as a result of peeling or blistered paint, breakage or damage due to rot.

As should be understood, the window 16 includes an existing window frame 18 which is a part of an existing building or structure 20. Be definition, the term "existing" includes new and old construction permanently erected prior to utilization of the preferred method and assembly 14. A head frame member 22 extends horizontally across the top of a window opening 24 and defines the top of the window frame 18. The jamb frame members 26, 28 of the window frame 18 extend along opposite sides of the window opening 24. A sill 30 juts outward from the structure 20 along the bottom of the window opening 24 to complete the window frame 18. The sill 30 may be relatively thick and outwardly tapered as illustrated, or uniform in thickness and relatively thin. The sill ends 32, 34 overlie the ends 36, 38, respectively, of the jamb frame members 26, 28. The upper ends 40, 42 of the jamb frame members 26, 28 abut the lower side edge 44 of the head frame member 22 along the ends 46, 48 of the head frame member 22. The front or outer surfaces 50, 52, 54 of the frame members 22, 26, 28 are planar, rectangular and coplanar with each other. The surfaces 50, 52 and 54 may project outward of the siding or like material of the structure 20 as shown, or be flush therewith.

Figure 9:
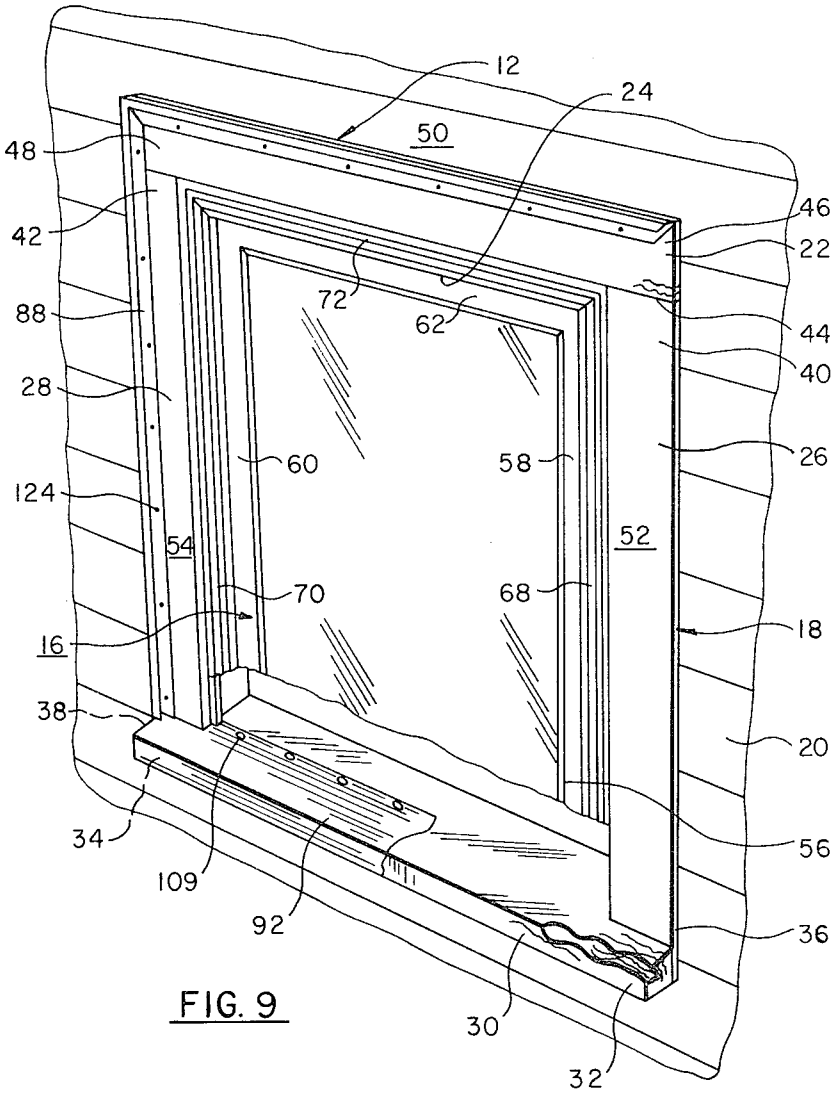
FIG. 9 is a broken pictorial view of the window of FIG. 1, during an early stage of rehabilitation.

As further shown in FIG. 9, a replacement sash 56 is installed in the window opening 24 as a part of the window 16. The sash comprises two sash side members 58, 60, a sash top member 62 and a sash bottom member 64 (FIG. 1). The sash 56 contains a glass panel 66 and is a part of a replacement assembly including side molding members 68, 70, top molding member 72 and bottom molding member 74 (FIG. 1). Referring to FIGS. 6 and 7, the side molding members 68, 70 and the upper molding member 72 each include an outward facing, cross-sectionally rectangular groove or channel recess 76 for receiving components of the assembly 14, as hereinafter described.

Referring to FIG. 2, the assembly 14 is comprised of the following: a head frame expander 78, the head frame expander receptor 12, two jamb frame expanders 82, 84, two jamb frame expander receptors 86, 88, a sill frame expander 90, and a sill nose cover 92.

Referring to FIG. 3, the head frame expander receptor 12 is exemplary of all three receptors 12, 86, 88. A fastener and abutment flange 94 of the receptor 12 is elongated in a longitudinal direction (perpendicular to the plane of FIG. 3), and extends in a transverse direction (the vertical direction in FIG. 3) from a joined end 96 to a free end 98. A longitudinally elongated, transversely extending fastener receiving area 100 is defined on the flange 94 adjacent the free end 98. The area 100 has a thickness in a direction perpendicular to the transverse direction (the horizontal direction in FIG. 3) reduced from the general thickness of the flange 94. The fastener area 100 is adapted to receive, or be pierced by, fasteners such as galvanized nails. A longitudinally elongated, transversely extending receptor flange 102 of the receptor 12 extends along the front or outer side of the flange 94. The flanges 94, 102 are joined by a riser portion 104, which is longitudinally elongated and extends in the perpendicular direction. At a joined end 106, the receptor flange 102 has a longitudinally elongated, flexible, reduced thickness biasing portion 108. The receptor flange 102 has a longitudinally elongated, transversely extending contact surface 110 facing the flange 94 from the biased portion 108 to the free end 112. The biased portion 108 biases the contact area 110 to a distance from the front surface 114 of the flange 94 substantially equal to and not greater than the thickness of the expanders 78, 82, 84. The flange 94, riser portion 104 and flange 102 form a expander receiving zone such as the expander receiving recess 116. The free end 112 of the flange 102 is nearer the riser portion 104 than the fastener receiving area 100, and thus the area 100 is accessible from the front of the receptor 12. A longitudinally elongated leg portion 118 is formed adjacent the riser portion 104, and extends in the perpendicular direction opposite the riser 104. A reduced thickness, weakened zone 120 is formed where the riser 104 meets the leg portion 118. The flange 12 is substanially uniform along its length.

As exemplified in FIG. 4, the expanders 78, 82, 84, 90 are also substantially uniform along their lengths. Each includes a generally planar cladding portion 122. The cladding portions 122 of the expanders 78, 82, 84 extend transversely (vertically in FIG. 4) from a receptor received end 130 to a backbend portion 132.

As shown in FIG. 5, the cladding portion 122 of the expander 90 is abbreviated, and extends to a backbend portion 132; the expander 90 has no receptor receiving end 130. The backbend portions 132 of the expanders 78, 82, 84 90 have a transverse dimension substantially equal to the width of the molding groove 76 (FIGS. 6, 7, 8) and a perpendicular dimension substantially equal to the depth of the molding groove 76. A back surface 134 of the cladding portion 122 is substantially planar, for overlying a frame member of the window 18, while a front surface 136 provides a display to the environment. The surface 136 may be finished, e.g., painted, as desired.

Referring to FIGS. 2 and 6, the sill nose cover 92 conforms generally to the shape of the sill 30. I.e., the sill nose cover 92 is longitudinally elongated, with elongated, substantially planar upper, outer edge and bottom surfaces 93, 95, 97 and closed ends 99, 101. The bottom surface 97 is substantially perpendicular to the edge surface 95. The upper surface 93 slopes upward, or away from the bottom surface 97, as it extends away from the edge surface 95.

The preferred method is begun by matching and fastening the sill nose cover 92 to the sill 30, after the sash 56 is installed. As necessary, the sill 30 is shimmed in thickness and length to provide firm support for the cover 92. Notches 103, 105 (FIG. 2) are then made in the upper surface 92 adjacent the ends 99, 101, to accommodate the jamb frame members 82, 84 and such other components of the frame 18 as necessary. The cover is then placed on the sill 30 and fastened along the upper edge 107 of the surface 94 to the sill 30 (FIG. 9). Fasteners such as exemplary fastener 109 are preferably aluminum nails.

The preferred method is continued by matching and fastening the receptors 12, 86, 88 to the frame members 22, 26 and 28. As in FIGS. 2 and 9, the receptor 88 is matched in length to the frame members 22, 28 so that the receptor 88 extends from the upper surface of the sill 30 to the uppermost corner of the head frame member 22. The receptor 88 is inwardly mitered at the upper end thereof. The receptor 12 is matched in size to the head frame member 22 so that the receptor 12 extends the full length of the member 22. The receptor 12 is inwardly mitered at both ends. The receptor 86 is matched to the frame member 28 as the receptor 88 is matched to the frame member 28. As in FIG. 9, the receptors 12, 88 are fastened to the window frame 18 along the outer edges of the frame members 22, 26, 28. The back surfaces 126 and the inner surfaces 128 of the flange 94 and the leg 118, respectively, are placed in abutment with the window frame 18 (FIG. 7). Fasteners such as exemplary fastener 124 are driven through the fastener receiving areas 100 to fasten the receptors 12, 88 to the window frame 18. The receptor 86 is similarly fastened to the jamb frame member 26, as in FIG. 10. A continuous bead of sealant (not shown) is applied along the edges 98 of the receptors 12, 86, 88, between the edges and the window frame 18.

Figure 10:
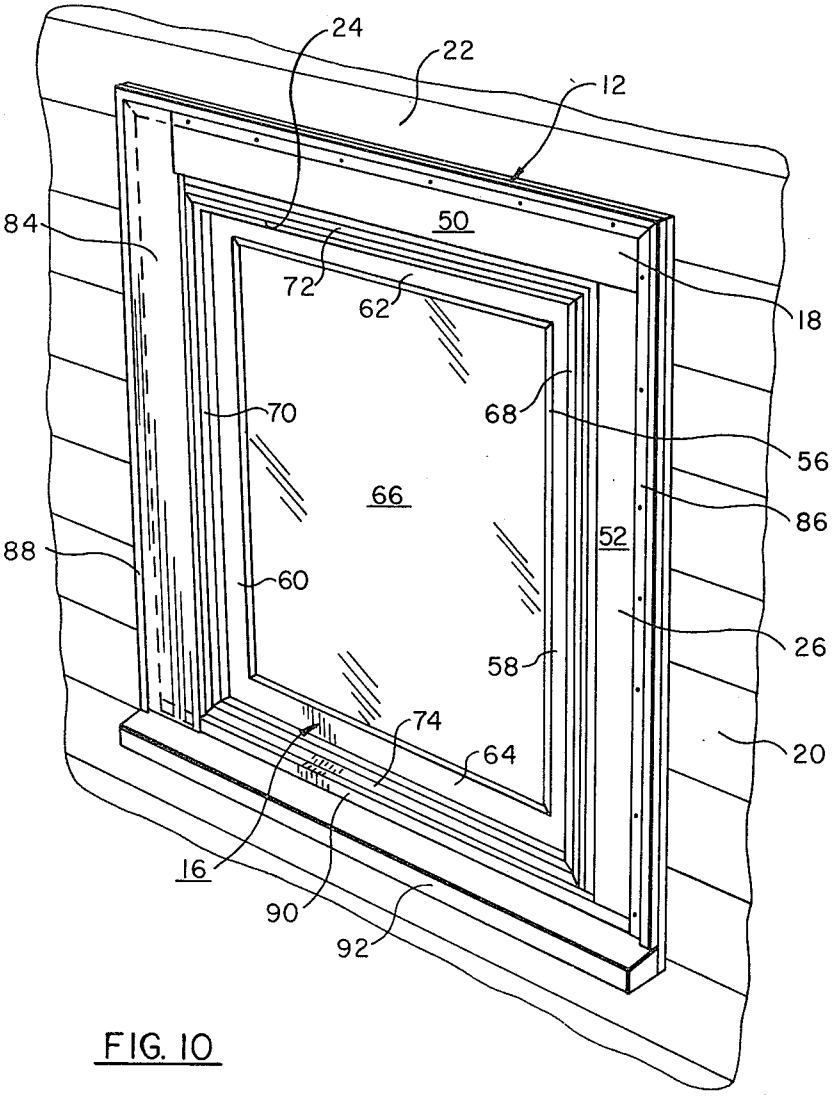
FIG. 10 is a pictorial view of the window of FIG. 1, during a stage of rehabilitation subsequent to the stage of FIG. 9.

Upon completion of fastening the receptors 12, 86, 88, the sill frame expander 90 is matched and mounted on the molding member 74, as in FIGS. 6 and 10. The backbend portion 132 is removed at the ends 127, 129 (FIG. 2) to accommodate the jamb frame members 26, 28. The expander 90 is trimmed in length to abut the receptors 86, 88, and in width to abut the sill nose cover 92. A continuous bead of sealant (not shown) is applied to the adjacent corner portions of the molding grooves 76 of the molding members 68, 70, 74, and along the backbend portion 132 of the expander 90 between the portion 132 and the back surface 134 thereof. The portion 132 is then driven into the groove 76 of the molding member 74, with the cladding portion 130 extending below the portion 132.

Figure 11:
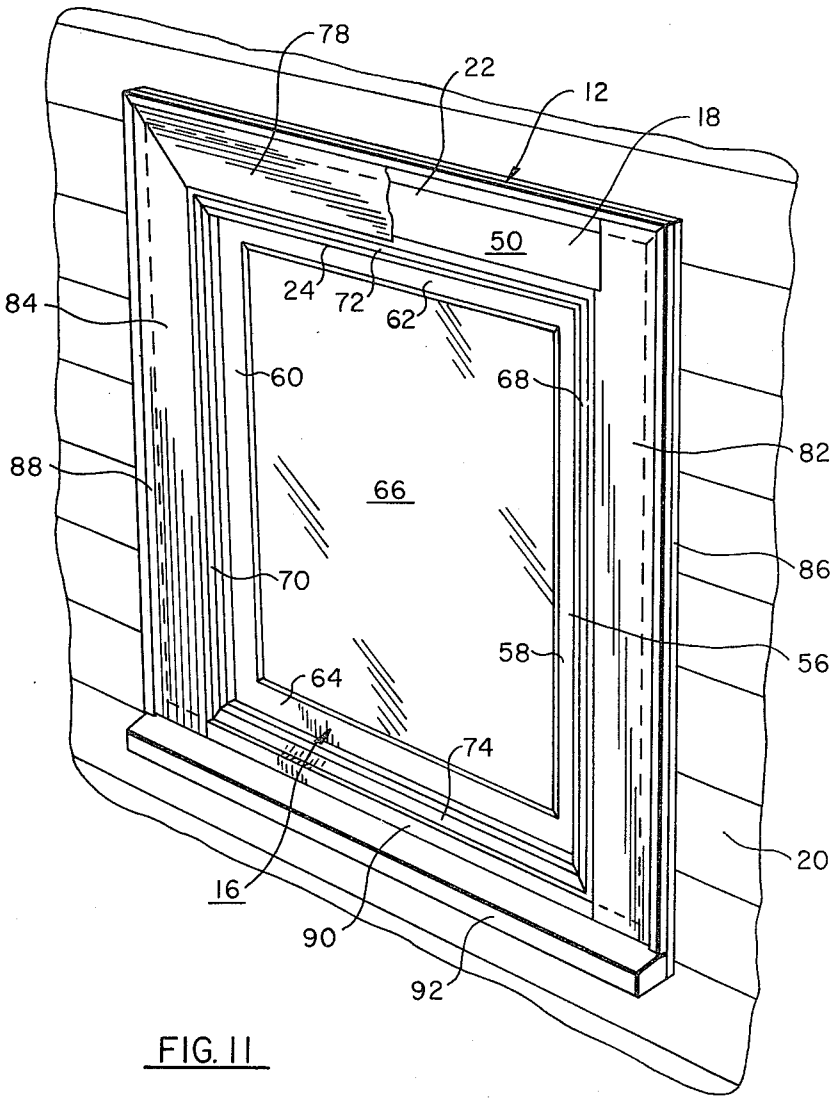
FIG. 11 is a broken, pictorial view of the window of FIG. 1, during a stage of rehabilitation subsequent to the stages of FIGS. 9 and 10.

Upon completion of mounting the expander 90, the jamb frame expanders 82, 84 are mounted on the receptors 86, 88. As in FIGS. 7 and 10, the expander 84 is first mounted on the receptor 88 and the molding 70. Initially, the backbend portion 132 is removed at the upper and lower ends of the expander 84 to accommodate the sill frame expander 90 and the head frame member 22. A continuous bead of sealant (not shown) is applied between the portion 132 and the back surface 134. The receptor received end 130 of the expander 84 is slid or otherwise moved into the receptor receiving recess 116. The backbend portion 132 of the jamb frame expander 84 is then pressed into the expander receiving groove 76 of the molding 70. So placed, the jamb frame expander 84 overlies the jamb frame member 28, the fastener area 100 of the flange 94 of the jamb frame expander receptor 88 and the fasteners 124 therein. The receptor flange 102 of the receptor 88 overlies the outer edge of the expander 84. The receptor 88 firmly retains the outer edge of the expander 84 and the molding groove 76 firmly retains the backbend area 132. As shown in FIG. 11, the other jamb frame expander 82 is similarly placed on the jamb frame expander receptor 86.

As further shown in FIG. 11, the expander 78 is mounted on the receptor 12 in substantially the same way the expanders 82, 84 are mounted. In advance of mounting, however, the expander 78 is inwardly mitered at the ends to a length along the backbend portion 132 equal to the length of the expander receiving groove 76 in the molding 72. The tapered ends of the expander 78 overlie the upper ends of the expanders 82, 84, to provide the pleasing, jointed wood appearance of FIG. 1 and prevent rainfall from entering above the expanders 82, 84.

Besides providing pleasing appearance, the expanders 12, 82, 84, 90 and the receptors 12, 86, 88 provide a substantially moisture proof or watertight seal between the frame 18, the fasteners 124 and the environment. Upwardly directed openings are eliminated, and the receptor flange 102 of the head frame expander receptor 12 acts as a drip cap for the window 16. As seen by comparing FIGS. 6 and 8, the receptor 12 (and the receptors 86, 88) are adapted to be utilized where possible with the leg portion 118 overlapping a portion of the window frame 18, although where necessary, the leg portion 118 may be removed along the weakened zone 120.

As preferred, the assembly 14 is formed of extruded aluminum, plastic or other material. Also as preferred, the expanders 78, 82, 84 are formed in ranges of widths for selection by a customer to suit a particular application.

To particularly point out and distinctly claim the subject matter regarded as invention, the following claims conclude this specification. It is to be understood that claims directed to a window frame expander receptor do not include the frame expander or the frame, and that claims directed to an apparatus for cladding a window frame do not include the frame.

What is claimed is:

1. An assembly for the exterior cladding of an existing window frame having a plurality of window frame members the assembly comprising: a plurality of window frame expanders each including an elongated, generally planar cladding portion adapted to clad a window frame member of the window frame and further adapted to overly a hereinafter defined fastener flange, the window frame expander further including an elongated receptor-received end adapted to be received by a hereinafter-defined receptor, the cladding portion of the window frame expander having a back surface adapted to be disposed adjacent the said window frame member of the window frame and a front, display surface adapted to be displayed to the environment;

and a plurality of window frame expander receptors each including an elongated fastener flange adapted to receive fasteners therein and an elongated, flexible receptor flange adapted to define a frame expander receiving zone along the fastener flange and further adapted to receive and retain the receptor-received end of the frame expander in the frame expander receiving zone;

whereby the window frame members of the existing, exterior window frame may be clad, the fasteners covered by the frame expanders and a moisture barrier created between the environment and the fasteners.

2. An assembly as claimed in claim 1 in which the receptor flange of each window frame expander receptor includes a planar contact area for contacting the receptor-received end of a frame expander received in the frame expander receiving zone.

3. An assembly as claimed in claim 1 in which the receptor flange of each window frame expander receptor includes means for biasing the receptor flange toward the frame expander receiving zone.

4. An assembly as in claim 1 in which the fastener flange of each window frame expander receptor is a longitudinally elongated, transversely extending fastener and abutment flange having a planar back surface adapted to abut a window frame member of the window frame, a planar fronr surface adapted to be abutted by a frame expander, a first, longitudinally elongated end and a second, longitudinally elongated free end with a longitudinally elongated fastener receiving zone therealong; in which each receptor further includes a longitudinally elongated riser joined to the first longitudinally elongated end and rising in a direction perpendicular to the longitudinal and transverse directions; and in which the receptor flange of each receptor is a longitudinally elongated, transversely extending receptor flange having a longitudinally elongated, transversely extending, flexible bias portion joined to the longitudinally elongated riser and a longitudinally elongated, transversely extending contact portion joined to the longitudinally elongated, transversely extending, flexible bias portion with a longitudinally elongated free edge nearer the riser than the fastener receiving zone and a longitudinally elongated, transversely extending contact area for contacting with a frame expander facing the front surface of the fastener and abutment flange; the fastener and abutment flange, the riser and the receptor flange adapted to define a longitudinally extending, generally U-shaped frame expander receiving recess therebetween, and the bias portion adapted to bias the contact area toward the front surface of the fastener and abutment flange, whereby the receptor may be fastened to a window frame member of the window frame and a frame expander snugly retained in the frame expander receiving recess, so that the window frame may be clad, the fasteners covered by the frame expander and a moisture barrier created between the environment and the fasteners and frame.

5. An assembly as claimed in claim 1 in which each receptor further includes a longitudinally elongated leg joined to the first, longitudinally extending fastener and abutment flange end, the leg extending in a direction opposite the direction of rise of the riser and adapted to clad the outer side of the window frame member.

6. An assembly for cladding a window frame as in claim 1 in which the window frame members include a head frame member and two jamb frame members, in which the expanders include a head frame expander and two jamb frame expanders, and further in which the receptors include a head frame expander receptor and two jamb frame expander receptors, the head frame expander including a generally planar cladding portion for cladding the head frame member and for overlying a hereinafter defined head frame expander receptor flange means, the head frame expander having a back surface for disposition adjacent the head frame member and a front, display surface for display to the environment;

the head frame expander receptor including fastener flange means for receiving fasteners therein and flexible receptor flange means for defining a head frame expander receiving zone along the fastener flange means for for retaining the head frame expander in the head frame expander receiving zone;

the two jamb frame expanders including fastener flange means for receiving fasteners therein and flexible receptor flange means for defining jamb frame expander receiving zones along the fastener flange means and for retaining the jamb frame expanders in the jamb frame receiving zones; and the two jamb frame expander receptors including fastener flange means for receiving fasteners therein and flexible receptor flange means for defining jamb frame expander receptor receiving zones along the fastener flange means and for retaining the two jamb frame expander receptors.

7. A cladding assembly as claimed in claim 6 for a window frame having a window frame sash therein, the head frame expander and the jamb frame expanders constituting frame expanders, each frame expander including means for mounting the frame expander on the window sash.

* * * * *